US008485168B2

(12) United States Patent
Walterscheid

(10) Patent No.: US 8,485,168 B2
(45) Date of Patent: Jul. 16, 2013

(54) TOY LAUNCHER WITH SAFETY PROJECTILES

(76) Inventor: Steve Walterscheid, Banks, OR (US)

( * ) Notice: Subject to any disclaimer, the term of this patent is extended or adjusted under 35 U.S.C. 154(b) by 172 days.

(21) Appl. No.: 13/225,438

(22) Filed: Sep. 3, 2011

(65) Prior Publication Data

US 2013/0055994 A1 Mar. 7, 2013

(51) Int. Cl.
*F41B 3/02* (2006.01)

(52) U.S. Cl.
USPC ..... 124/20.1

(58) Field of Classification Search
USPC ..... 124/20.1, 20.2, 20.3
See application file for complete search history.

(56) References Cited

U.S. PATENT DOCUMENTS 5,279,276 A * 1/1994 Nagel et al. ..... 124/20.1
5,282,453 A * 2/1994 Chia ..... 124/20.1
5,657,738 A * 8/1997 Klundt ..... 124/17
6,500,042 B1 * 12/2002 LaPointe ..... 446/64

* cited by examiner

*Primary Examiner* — John Ricci
(74) *Attorney, Agent, or Firm* — LaMorte & Associates P.C.

(57) ABSTRACT

A toy launcher and safety projectile combination, wherein the launcher only launches a safety projectile. The slingshot has a body with a first arm section and a second arm section. A first elastomeric element extends laterally from the first arm. Likewise, a second elastomeric element extends laterally from the second arm section. A safely projectile is provided. The safety projectile has a first slotted channel that is accessible through a first open end and a second slotted channel that is accessible through a second open end. The safety projectile temporarily attaches to the first elastomeric element and the second elastomeric element during launching by having the first slotted channel receive the first free end of the first elastomeric element and having the second slotted channel receive the second free end of the second elastomeric element. The safety projectile is then pulled back and released.

19 Claims, 6 Drawing Sheets

TOY LAUNCHER WITH SAFETY PROJECTILES

BACKGROUND OF THE INVENTION

1. Field of the Invention

In general, the present invention relates to toy launchers, such as slingshots that are used to launch a toy projectile into flight.

2. Prior Art Description

Slingshots and similar launchers that are designed for child's play have existed throughout recorded history. In the modern era, toy slingshots typically have a plastic molded handle and an elastic string. A pocket is present on the elastic string. Objects are launched by placing the object in the pocket, pulling the pocket back against the bias of the elastic string, and releasing the pocket.

Due to the nature of its design, any slingshot, including toy slingshots, are capable of launching any object that is placed in the pocket. Although a toy slingshot may be sold with safety projectiles, a child can easily launch a small stone with equal ease. It will therefore be understood that even toy slingshots can cause injury if used in an unwise fashion.

Another problem with toy slingshots is their failure mode. If a slingshot is drawn beyond its limit, then the string of the slingshot may break. Depending upon where the breakage occurs, the broken string may fly back toward the person holding the slingshot as the stored energy is accidentally released. Since a slingshot is often held in front of the face, the whip-back of a broken string can easily cause injury to the eye.

A need therefore exists for a toy slingshot design that enables the toy slingshot only to shoot the safety projectiles that are packaged with the toy slingshot. Furthermore, a need exists for a slingshot design that eliminates the dangers of string failure to a child who may overdraw the slingshot. This need is met by the present invention as described and claimed below.

SUMMARY OF THE INVENTION

The present invention is a toy projectile launcher and safety projectile combination, wherein the launcher sets the safety projectile into flight. The toy launcher can only launch the safety projectile. The toy launcher has a body with a first arm section, a second arm section and an central region that separates the first arm section and the second arm section.

A first elastomeric element extends laterally from the first arm section into the central region. The first elastomeric element has a first free end that is supported as a cantilever. Likewise, a second elastomeric element extends laterally from the second arm section into the central region. The second elastomeric element has a second free end that is also supported as a cantilever.

A safely projectile is provided. The safety projectile has a first slotted channel that is accessible through a first open end and a second slotted channel that is accessible through a second open end. The safety projectile temporarily attaches to the first elastomeric element and the second elastomeric element during launching by having the first slotted channel receive the first free end of the first elastomeric element and having the second slotted channel receive the second free end of the second elastomeric element.

The safety projectile is then pulled back and released. The needed engagement of the two slotted channels of the projectile with the two elastomeric elements of the slingshot ensure that only authorized, safety projectiles can be launched.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy launching system can be embodied in many ways, three exemplary embodiments of the present invention toy launching system are illustrated. The exemplary embodiments have been selected in order to set forth the best modes contemplated for the invention. The illustrated embodiments, however, are merely exemplary and should not be considered limitations when interpreting the scope of the appended claims.

Figure 1:
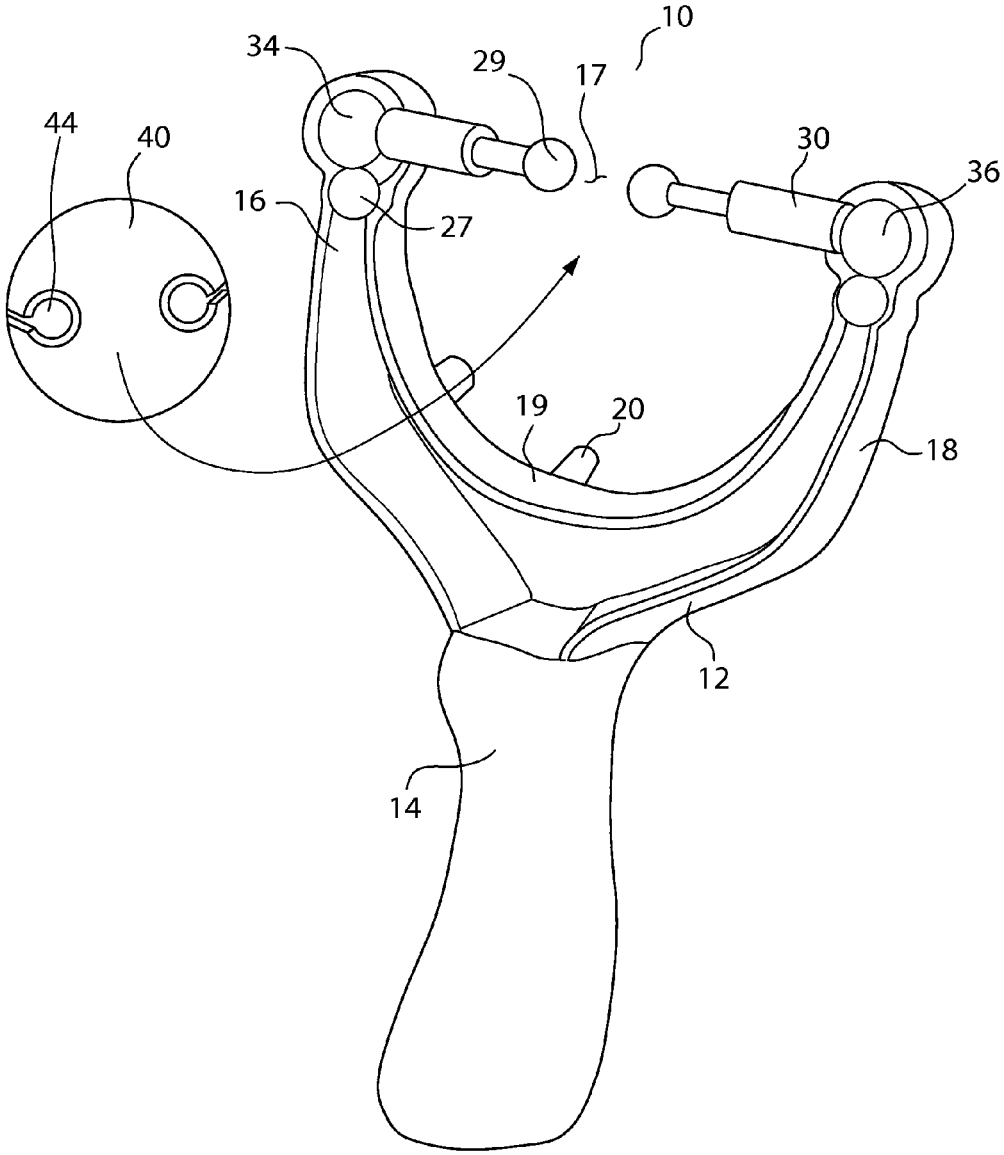
FIG. 1 is a perspective view of an exemplary embodiment of a toy slingshot assembly and safety projectile in combination.
Figure 2:
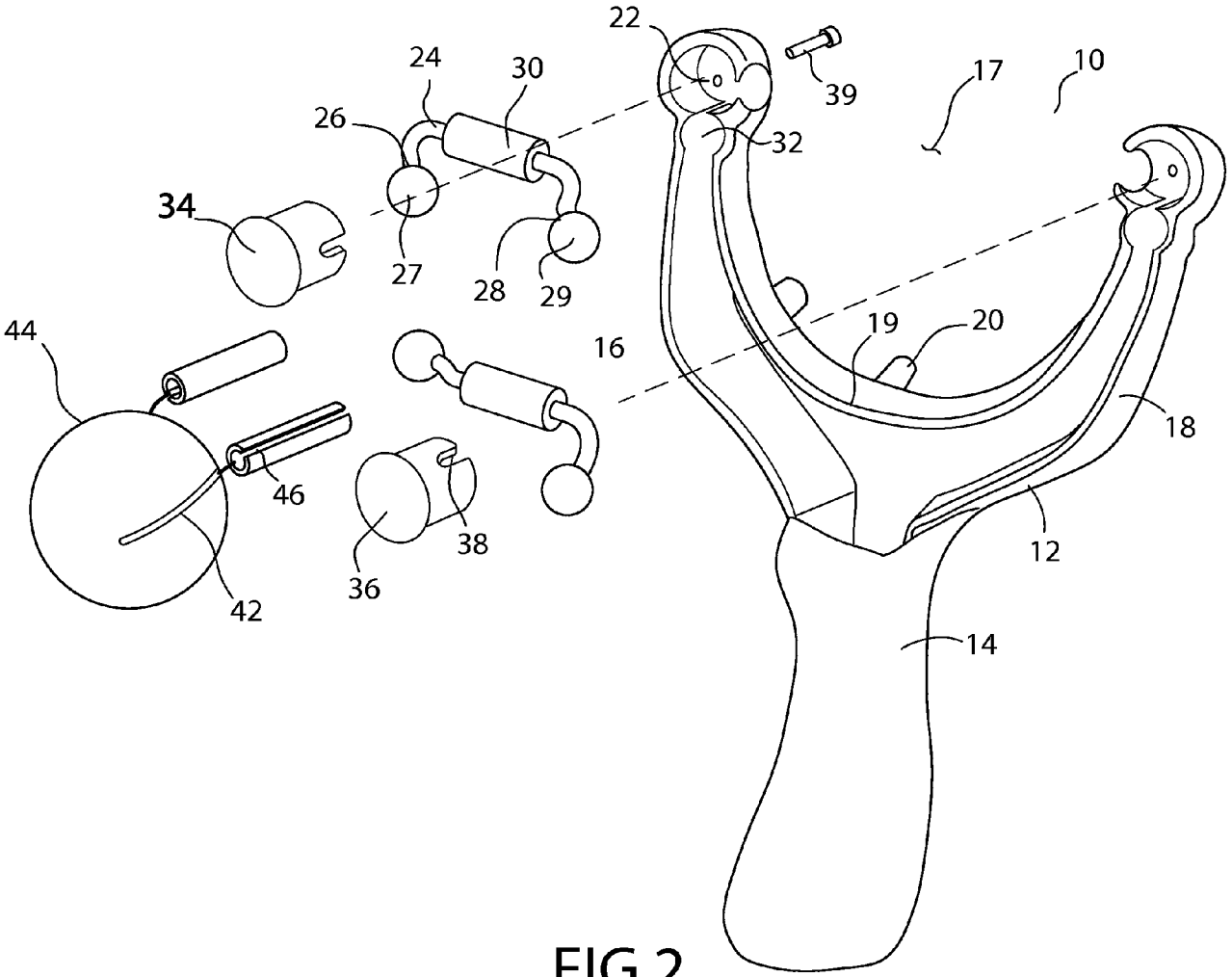
FIG. 2 is an exploded view of the embodiment of FIG. 1.

Referring to FIG. 1 in conjunction with FIG. 2, a first exemplary embodiment of a slingshot assembly 10 is shown. The slingshot assembly 10 has a body 12 that is generally Y-shaped. The body 12 includes a handle 14 and two arms 16, 18 that are spaced a predetermined distance part by a central region 17. Although the body 12 can be fabricated from wood or metal, for the mass manufacture of toys molded plastic is preferred. To reduce mass and increase strength, the arms 16, 18 and handle 14 may be molded with reinforcement ribs 19. Furthermore, projections 20 extend outwardly from the body 12, for a purpose that will be later described.

The top of each arm 16, 18 terminates with an enlarged relief 22. The purpose of the large reliefs 22 is later explained in detail.

Two elastomeric elements 24 are provided. The elastomeric elements 24 can be solid strands of elastomeric material or segments of elastomeric tubing. Each of the elastomeric elements 24 extends straight between an anchor end 26 and a free end 28. Both the anchor end 26 and the free end 28 are terminated with an enlarged bead 27, 29 that is permanently affixed to the elastomeric element 24. The beads 27, 29 are preferably made of a hard plastic so that the beads 27, 29 do not deform when stressed by the operation of the slingshot assembly 10. Conversely, the elastomeric elements 24 are highly elastomeric and are capable of elastically expanding to at least three times their original length without tearing or breaking when stressed.

A segment of reinforcement tubing 30 is provided around each of the elastomeric elements 24. The reinforcement tubing 30 is thicker, tougher, and less elastic than the elastomeric elements 24. Although the reinforcement tubing 30 lay around sections of the elastomeric elements 24, the reinforcement tubing 30 is not bonded or otherwise attached to the material of the elastomeric elements 24.

An anchor port 32 is formed in each of the arms 16, 18 of the slingshot body 12 below the large reliefs 22. The anchor ports 32 are sized to receive the anchor bead 27 at the anchor end 26 of the elastomeric elements 24. When the anchor bead 27 enters the anchor port 32, the anchor bead 27 becomes wedged in place and cannot move. This connects the anchor end 26 of each of the elastomeric elements 24 to the arms 16, 18 of the slingshot body 12.

Two plug elements 34, 36 are provided. Each of the plug elements 34, 36 defines a bottom slot 38 that turns ninety degrees. The plug elements 34, 36 pass into the large reliefs 22 at the top of the arms 16, 18. The elastomeric elements 24 pass through the slots 38 in the plugs 34, 36. Consequently, the elastomeric elements 24 are bent ninety degrees as they extend through the bottom slot 38. As a result, the free end 28 of each elastomeric element 24 extends horizontally toward the each other in the central region 17. As a result, both elastomeric elements 24 have free ends 28 that extend toward each other and terminate as cantilevered structures. The free end beads 29 at the ends of the elastomeric elements 24 are disposed a predetermined distance D1 apart.

The plug elements 34, 36 also engage one end of each segment of the reinforcement tubing 30. The segments of reinforcement tubing 30 also extend horizontally toward one another as cantilevered structures. The support provided by the reinforcement tubing 30 helps prevent the elastomeric elements 24 from sagging under the force of gravity.

The plug elements 34, 36 are attached to the large reliefs 22 using either adhesive and/or a mechanical fastener, such as the shown screw 39.

Figure 3:
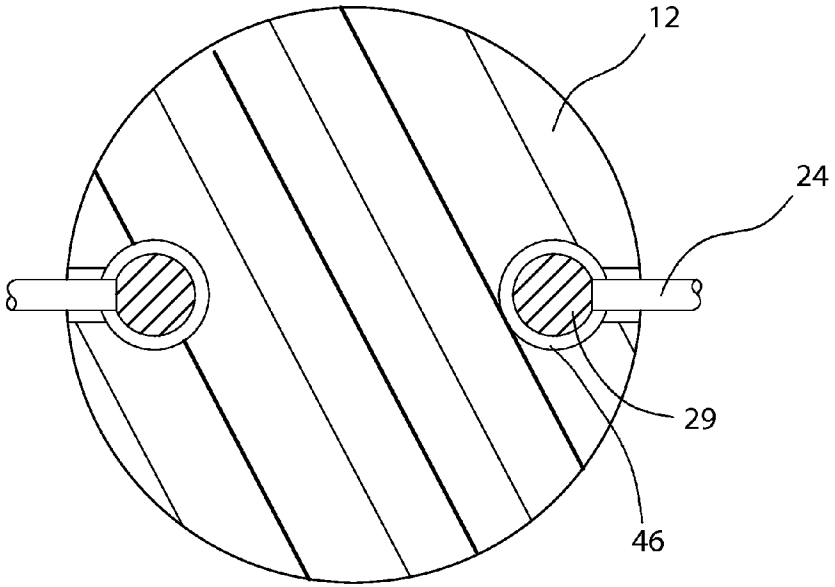
FIG. 3 is a cross-sectional view of the safety projectile shown while engaging the elastomeric elements of the slingshot assembly.

Referring to FIG. 2 in conjunction with FIG. 3, it can be seen that safety projectiles 40 are provided. Each safety projectile 40 is made of a foam rubber or similar low-density polymer formulation. In the shown embodiment, the safety projectiles 40 are spherical. However, it should be understood that other shapes, such as airplane shapes and rocket shapes can be used.

Slotted channels 42 are formed in the safety projectiles 40. Each slotted channel 42 has only one open end 44. The open ends 44 of the two slotted channels 42 are spaced a predetermined distance D2 apart. The distance D2 between the open ends 44 of the slotted channels 42 are exactly the same as the distance D1 between the beads 29 at the free ends 28 of the elastomeric elements 24. It will therefore be understood that the beads 29 at the free ends 28 of the elastomeric elements 24 can easily pass into the slotted channels 42 of the safety projectile 40 through the open ends 44 of the slotted channels 42.

Each of the slotted channels 42 are lined with a slotted hard plastic insert 46. The presence of the hard plastic insert 46 prevents the hard free end beads 29 of the elastomeric elements 24 from being pulled out the slotted channel 42 through the soft material of the safety projectile 40.

Figure 4:
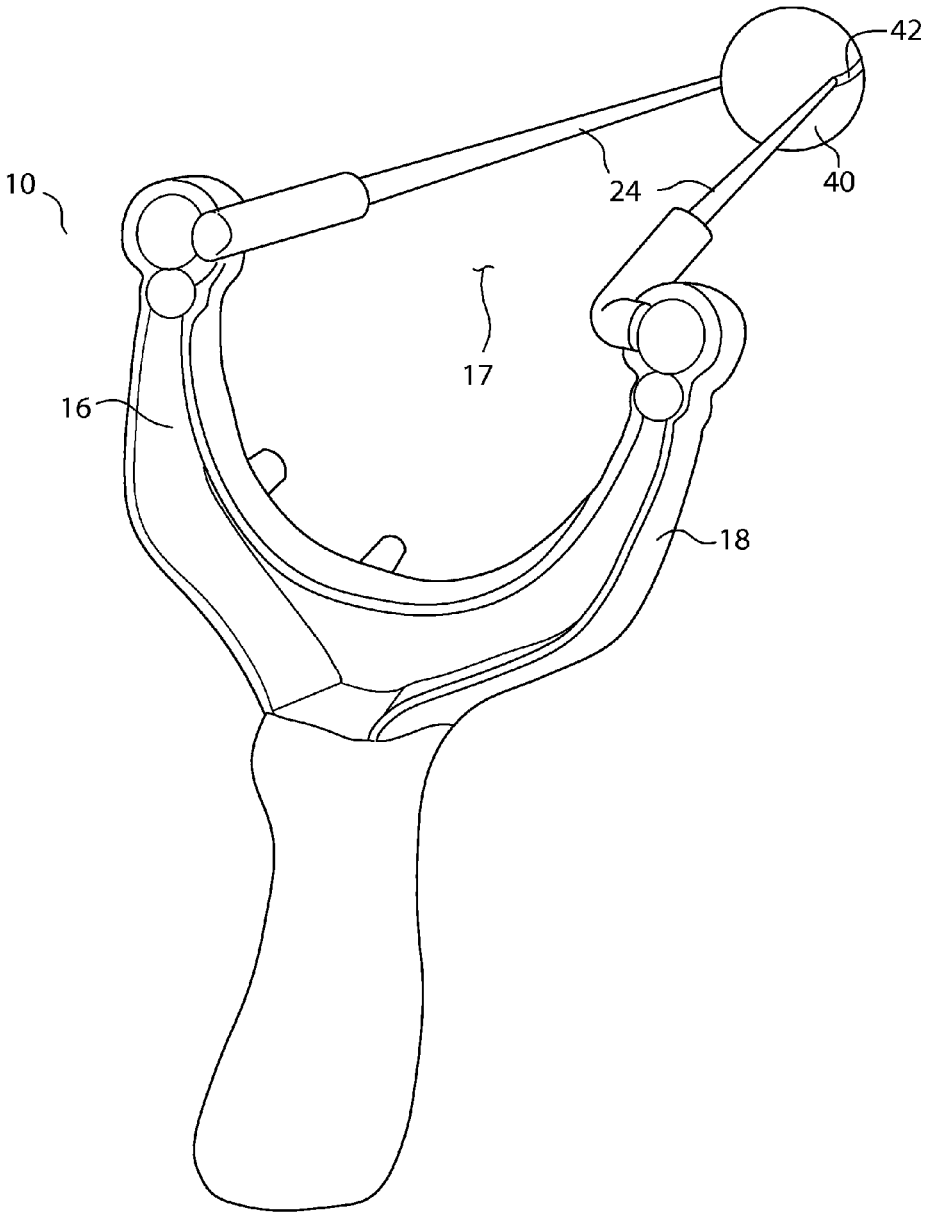
FIG. 4 shows the slingshot assembly loaded and drawn with the safety projectile.

Referring to FIG. 4 in conjunction with FIG. 2 and FIG. 3, it will be understood that in order to utilize the slingshot assembly 10, a person takes the slingshot assembly 10 and maneuvers the safety projectile 40 until the beads 29 at the free ends 28 of the elastomeric elements 24 enter the open ends 44 of the slotted channel 42 on the safety projectile 40. This interconnects the safety projectile 40 with the elastomeric elements 24 of the slingshot assembly 10. The safety projectile 40 is then manually grasped and pulled rearwardly in the horizontal plane. This causes the elastomeric elements 24 to stretch and store energy. When the safety projectile 40 is released, the spring energy stored in the elastomeric elements 24 is released and the safety projectile 40 is accelerated forward. Once the safety projectile 40 passes between the arms 16, 18 of the slingshot body 12, the free end beads 28 slide rearwardly in the slotted channels 42 and exit the slotted channels 42 through their open ends 44. At this moment, the safety projectile 40 disengages from the elastomeric elements 24 and the safety projectile 40 flies freely forward.

It will be understood that the elastomeric elements 24 of the slingshot assembly 10 can only engage a projectile that has the slotted channels 42 that are sized and spaced to receive the two beads 29 at the two free ends 28 of the elastomeric elements 24. Consequently, the present invention slingshot assembly 10 cannot launch a rock, marble, gumball, or anything else that is not specifically manufactured with the necessary slotted channels. A child having possession of the slingshot assembly 10 will therefore only be able to use the slingshot assembly 10 to launch the safety projectiles 40 provided with the slingshot assembly 10.

When the elastomeric elements 24 are stretched, they are most vulnerable to breakage. If one of the elastomeric elements 24 breaks, it is highly improbable that the second elastomeric element 24 would break at that precise moment. The unbroken elastomeric element 24 will, therefore, remain intact and will absorb much of the energy released by the broken elastomeric element. This prevents a broken elastomeric element from whipping back toward a user's face.

The slotted channels 42 within the safety projectile 40 have the same diameter as the projections 20 that extend outwardly from the slingshot body 12. This enables a projection 20 to pass into and engage the safety projectiles 40 with an interference fit. As a result, safety projectiles 40 that are not being used can be attached to the body 12 of the slingshot assembly 10 and held at the ready.

Figure 5:
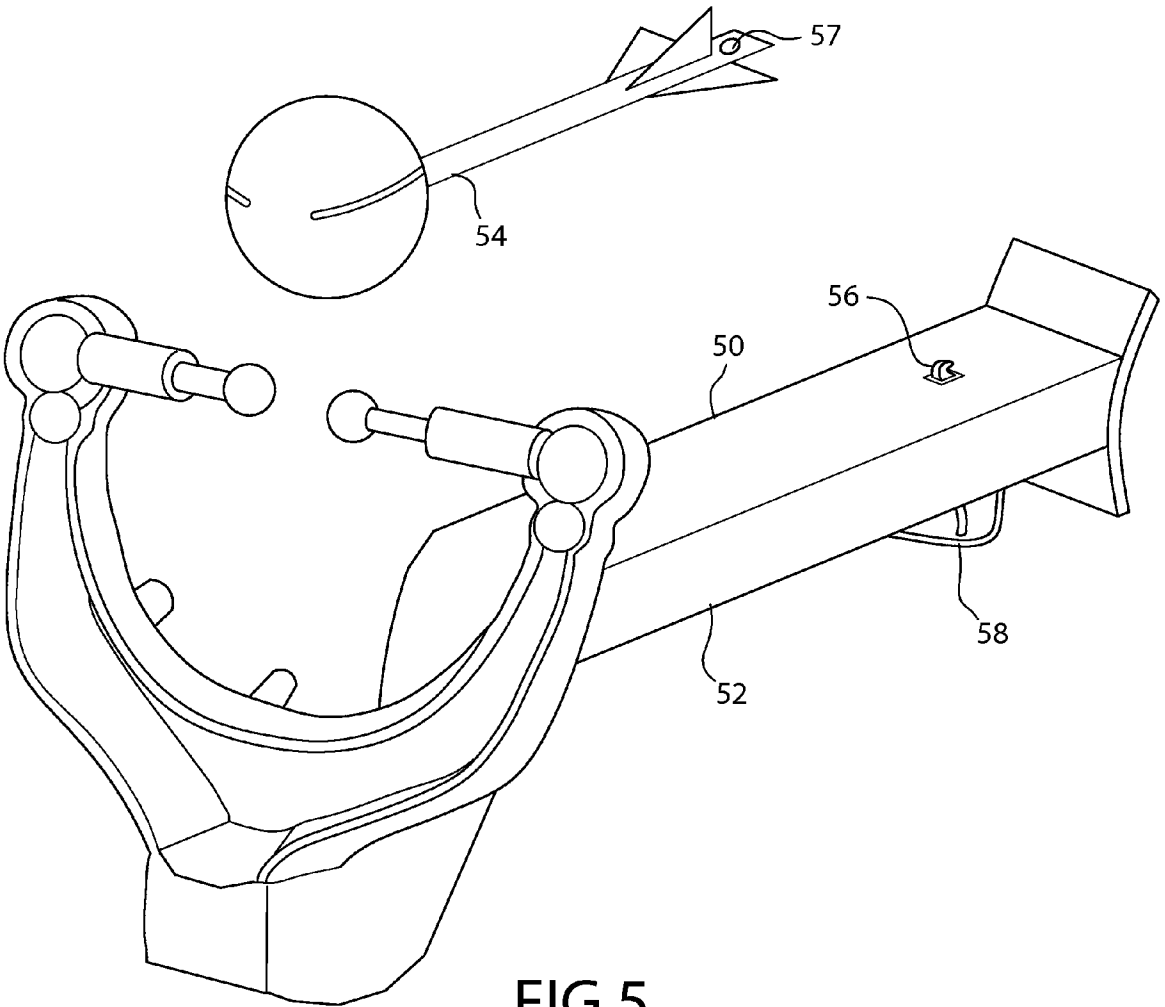
FIG. 5 is a perspective view of an alternate embodiment of the toy assembly configured as a crossbow.

Referring to FIG. 5, an alternate embodiment of the present invention system is shown. In this embodiment, the slingshot structure is configured as a crossbow 50. The crossbow 50 has arm sections 16, 18 and elastomeric elements 24 that are the same as was previously explained. Accordingly, these elements are identified with the same reference numbers. In this embodiment, the structure now includes a stock 52 that can hold a safety projectile 54 in a loaded position. A catch 56 is provided on the stock 52 that engages the safety projectile 54 and prevents it from launching. The catch 56 is operated by a trigger mechanism 58 that is positioned under the stock 52. When a user activates the trigger mechanism 58, the safety projectile 54 is released by the catch 56 and the safety projectile 54 is launched into flight.

In this embodiment, the safety projectile 54 has a head section 62 and a tail section 60. It is the tail section 60 that is engaged by the catch 56. The tail section 60 has an aperture 57 or hook that can be engaged by the catch 56. The slotted channels 42 are formed on the sides of the head section 62 and engage the elastomeric elements 24 in the same manner as was previously described for the first embodiment.

Figure 6:
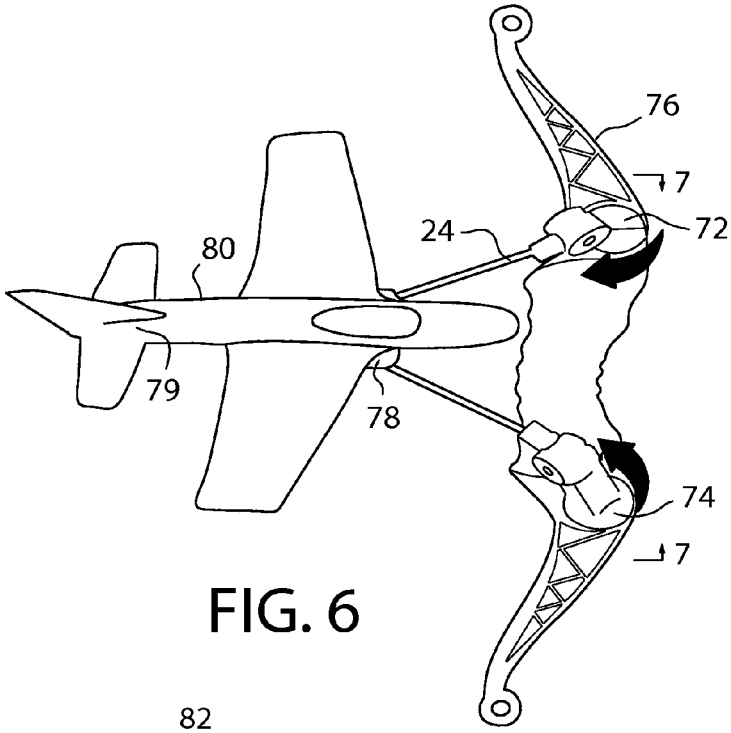
FIG. 6 is a perspective view of an alternate embodiment of the toy assembly configured as a bow and arrow assembly.
Figure 7:
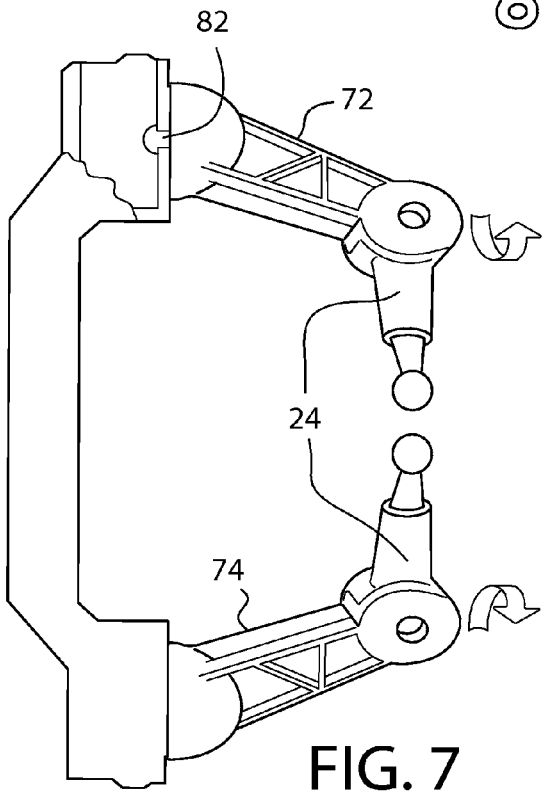
FIG. 7 is a side view of a segment of the embodiment of FIG. 6, viewed along section line 7-7.

Referring to both FIG. 6 and FIG. 7, a second alternate embodiment of the present invention system is shown. In this embodiment, the launching structure operates as a slingshot, but has the appearance of a handheld bow 70. The bow 70 has arm sections pivoting arm sections 72, 74. The pivoting arm sections 72, 74 support elastomeric elements 24 that are the same as was previously explained. Accordingly, the elastomeric elements 24 are identified with the same reference numbers. In this embodiment, the structure now includes a bow handle 76 that can manually held in a vertical position.

In this embodiment, the safety projectile 80 has a head section 78 and a tail section 79. It is the tail section 79 that is grasped and pulled by a user. Slotted channels are formed on the sides of the head section 78 and engage the elastomeric elements 24 in the same manner as was previously described for the first embodiment.

In this embodiment, each of the pivoting arm sections 72, 74 are connected to the bow handle 76 with a pivot connection 82. This enables the pivoting arm sections 72, 74 to rotate when tension is applied to the elastomeric elements 24. The rotation of the pivoting arm sections 72, 74 reduces the shearing forces experienced by the elastomeric elements 24 and extends the life of the elastomeric elements 24.

It will be understood that the embodiments of the present invention that are illustrated and described are merely exemplary and that a person skilled in the art can make many variations to those embodiments. For instance, the bow structure can have many different ornamental shapes. Likewise, the arrow projectiles can be configured as airplanes, rocket ships or any other flying projectile. All such embodiments are intended to be included within the scope of the present invention as defined by the claims.

What is claimed is:

1. A projectile launcher and safety projectile combination, wherein said projectile launcher launches said safety projectile into flight, said combination comprising:

a body having a first arm section and a second arm section, wherein said first arm section and said second arm section are separated by an open central region;

a first elastomeric element extending laterally from said first arm section into said central region, wherein said first elastomeric element has a first free end;

a second elastomeric element extending laterally from said second arm section into said central region, wherein said second elastomeric element has a second free end;

a safely projectile having a first slotted channel that is accessible through a first open end and a second slotted channel that is accessible through a second open end, wherein said safety projectile temporarily attaches to said first elastomeric element and said second elastomeric element during launching by having said first slotted channel receive said first free end of said first elastomeric element and having said second slotted channel receive said second free end of said second elastomeric element.

2. The combination according to claim 1, further including a first hard bead affixed to said first free end of said first elastomeric element and a second hard bead affixed to said second free end of said second elastomeric element.

3. The combination according to claim 2, wherein said first bead passes into said first slotted channel during launching and said second bead passes into said second slotted channel during launching.

4. The combination according to claim 1, wherein said safety projectile includes a structure fabricated from a polymer foam, wherein first slotted channel and said second slotted channel are formed in said polymer foam.

5. The combination according to claim 4, further including hard plastic inserts that line said first slotted channel and said second slotted channel.

6. The combination according to claim 1, further including a first reinforcement tube that surrounds a portion of said first elastomeric element and a second reinforcement tube that surrounds a portion of said second elastomeric element.

7. The combination according to claim 1, wherein said safety projectile is generally spherical in shape.

8. The combination according to claim 1, wherein said first slotted channel and said second slotted channel are aligned in parallel orientations.

9. The combination according to claim 1 wherein said first slotted channel and said second slotted channel are a predetermined distance apart and said first free end of said first elastomeric element and said second free end of said second elastomeric element are also said predetermined distance apart.

10. A toy launcher assembly, comprising:

a body having a first arm section and a second arm section, wherein an open central region separates said first arm section and said second arm section;

a first elastomeric element extending laterally from said first arm section into said central region, wherein said first elastomeric element has a first free end that terminates with an enlarged head;

a second elastomeric element extending laterally from said second arm section into said central region, wherein said second elastomeric element has a second free end that terminates with a second enlarged head.

11. The assembly according to claim 10, wherein said first elastomeric element has an anchor end, opposite said first free end, that is anchored to said first arm section.

12. The assembly according to claim 10, wherein said second elastomeric element has an anchor end, opposite said second free end, that is anchored to said second arm section.

13. The assembly according to claim 10, wherein said enlarged head on said first elastomeric element is a hard plastic bead affixed to said first free end of said first elastomeric element.

14. The assembly according to claim 10, further including a first reinforcement tube that surrounds a portion of said first elastomeric element, wherein said first reinforcement tube is anchored to said first arm section and extends as a cantilever into said central region.

15. The assembly according to claim 14, further including a second reinforcement tube that surrounds a portion of said second elastomeric element, wherein said second reinforcement tube is anchored to said second arm section and extends as a cantilever into said central region.

16. The assembly according to claim 10, wherein said body includes a handle that combines with said first arm section and said second arm section to create a generally Y-shaped structure.

17. A safety projectile assembly to be launched from a toy launcher, said projectile comprising:

a foam body;

two slotted channels formed in parallel in said foam body a predetermined distance apart, wherein each of said slotted channels has a single open end; and a hard slotted plastic insert lining each of said two slotted channels.

18. The assembly according to claim 17, wherein said foam body includes a head section and a tail section, wherein a catch is formed in said tail section.

19. The assembly according to claim 17, wherein said foam body is generally spherical in shape.

* * * * *